United States Patent [19]

Cope

[11] 4,049,116

[45] Sept. 20, 1977

[54] BOTTLE AND GLASS CARRIER

[75] Inventor: Kenneth Cope, Dayton, Ohio

[73] Assignee: Neff Folding Box Company, Dayton, Ohio

[21] Appl. No.: 741,471

[22] Filed: Nov. 12, 1976

[51] Int. Cl.[2] ..... B65D 85/30; B65D 5/46; B65D 5/48

[52] U.S. Cl. ..... 206/176; 40/324; 206/194; 206/196; 206/459; 206/586

[58] Field of Search ..... 206/142, 143, 145, 147, 206/160, 162, 176–179, 194–199, 443, 459, 586; 229/28 BC, 52 BC; 40/310, 324, 308, 312

[56] References Cited

U.S. PATENT DOCUMENTS

| | | | |
|---|---|---|---|
| 1,965,886 | 7/1934 | Everhart | 206/196 X |
| 1,995,280 | 3/1935 | Everhart | 229/52 BC X |
| 2,581,100 | 1/1952 | Hennessy | 206/194 X |
| 2,701,661 | 2/1955 | Murray | 206/194 X |
| 2,711,843 | 6/1955 | Van Rosen et al. | 206/194 X |
| 2,802,597 | 8/1957 | Davis | 206/194 X |
| 3,168,963 | 2/1965 | Wolowicz | 206/194 X |
| 3,752,310 | 8/1973 | Higgin | 206/427 |
| 3,773,214 | 11/1973 | Lemon | 206/194 |

FOREIGN PATENT DOCUMENTS

| | | | |
|---|---|---|---|
| 569,194 | 10/1963 | Belgium | 206/194 |
| 1,270,068 | 7/1961 | France | 206/194 |
| 1,185,620 | 2/1959 | France | 206/194 |
| 728,975 | 4/1955 | United Kingdom | 206/194 |
| 1,368,624 | 10/1974 | United Kingdom | 206/427 |

*Primary Examiner*—Stephen Marcus
*Attorney, Agent, or Firm*—Biebel, French & Nauman

[57] ABSTRACT

A carrier for glasses or bottles is formed from a single blank of material and with a single die. During assembly the adhesive may be applied with a single line gluer, and the assembled carrier is adjustable to accommodate articles of different heights. An optional separator piece is used to separate the top rims of various height glasses within the carrier.

9 Claims, 11 Drawing Figures

BOTTLE AND GLASS CARRIER

BACKGROUND OF THE INVENTION

This invention relates to carriers, and more particularly to a glass or bottle carrier which may be adjusted for glasses or bottles which are either short or tall.

Bottle and glass carriers are well-known but are usually relatively complicated in structure and design, and are limited to use with a particular predetermined type and size of article. Such carriers are therefore relatively expensive to design, must be redesigned for other sizes and types of articles, and are also relatively expensive to fabricate.

A need thus remains for an inexpensive, uncomplicated, and versatile carrier of a single design configuration which can accommodate several (for example six) glasses or bottles of one height, or a like number of a different height, which can maintain the glass or bottle articles in separated, upright positions to avoid breakage in transit, which can be stacked one upon another regardless of the height of the articles therein, which uses a minimum of material (e.g., paperboard), and which is relatively easy to fabricate on inexpensive production equipment. It is also desirable that such a carrier can be easily set up by the user, and that the carrier will give maximum store shelf exposure to the articles it contains when on display in a retail establishment.

SUMMARY OF THE INVENTION

Briefly, the present invention provides a carrier for glasses or bottles which, in the preferred embodiment, will hold six such articles in separated, upright positions. The carrier is fabricated from a single piece of paperboard and will accommodate two different article sizes. It may be formed with a single die, and the glue can be applied by a straight line gluer, no right angle gluing being required.

Conceptually, the present invention places the handle portions at one end of the carrier blank, attached to a major divider wall. The handle portions are then folded about the blank, through a slot in the middle thereof, to form one-half of the carrier. The other half of the carrier is folded in a complementary fashion to bring a short divider wall around to meet the major divider wall. A glue line adheres the short divider wall to the major divider wall, thus forming the other side of the carrier and completing the assembly.

The carrier may then be folded flat for storage and shipment, and is subsequently easily erected for use. When erected, the side walls of the carrier are pressed down over lock tabs at the base of the handle to hold the carrier in the erected position. The glass or bottle articles are received through elliptical cutouts in the side walls which, along with separator tabs formed in the bottom walls of the carrier, keep the bottoms and sides of the articles separated to avoid breakage in storage and transit.

A separate, optional separator piece may then be inserted through the handle cutout above the glass articles and over the carrier side walls. The separator piece is free to float up or down within the handle slot according to the height of the articles within the carrier. Downwardly extending wings on the separator piece are positioned between the tops of the articles (such as the rims of glasses) to separate them and protect them from damage in transit.

A rim tab extends into the handle cutout, and the separator piece has a centered slot which receives the rim tab therein. The rim tab is for separating the rims of glasses opposite one another on either side of the handle cutout so that the glasses do not bump, chip, or break one another. The separator piece slot allows the separator piece to float up or down around the rim tab, depending upon the height of the articles within the carrier. The separator piece is open toward the sides of the carrier, and is especially designed to protect the articles within the carrier while not obstructing full view of the articles when displayed in a retail establishment. Thus the separator piece may be left in position at all times.

In the preferred embodiment the separator piece may be used as a type of "merchandiser card" for identifying the particular product and manufacturer. In this way the carriers themselves may have a standardized configuration with a single, "universal" artwork design thereon. The single design can be fabricated in very large quantities with substantial savings in unit costs, since the merchandiser card is used to identify the particular product and manufacturer. A single carrier design can thus be used for numerous different glass or bottle designs and sources, since the merchandiser cards can be much less expensively custom printed with the appropriate legends, designs, etc. In other words, changes or differences in product and/or manufacturer can be much more economically accommodated in the present invention by changing just the merchandiser card, rather than changing the printing and design on the entire carton.

It is therefore an object of the present invention to provide a single design configuration carrier for glasses or bottles whether they are short or tall; which will keep the articles in upright, separated positions to avoid breakage in transit; which can be stacked one upon another regardless of the height of the articles therein; which will give maximum shelf exposure to the articles in retail establishments; which minimizes printing costs without loss of versatility; which may be easily and inexpensively made of paperboard material, and which uses a minimum thereof; which may be fabricated with simple, straight line gluing equipment; which may be folded flat for shipment and easily erected and assembled for use in the customer's loading operation; and to accomplish the above objects and purposes in an inexpensive, uncomplicated and durable structure which is versatile and readily suited to a wide variety of applications and uses.

Other objects and advantages of the invention will be apparent from the following description, the accompanying drawings and the appended claims.

DESCRIPTION OF THE PREFERRED EMBODIMENT

Figure 1:
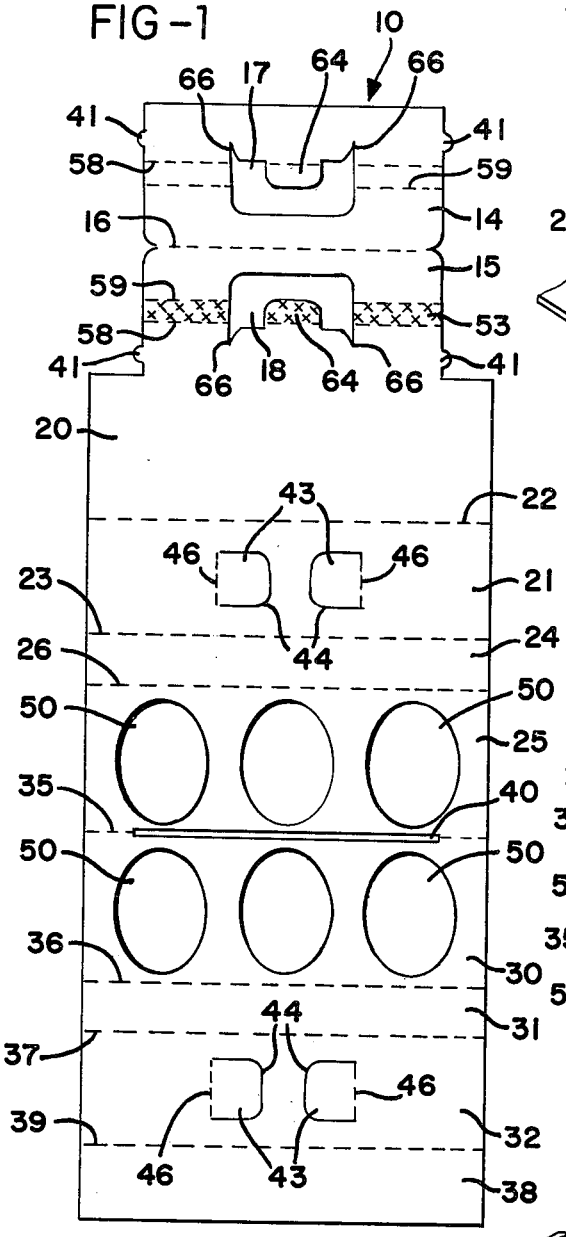
FIG. 1 is a plan view of the blank from which the carrier is formed.
Figure 4:
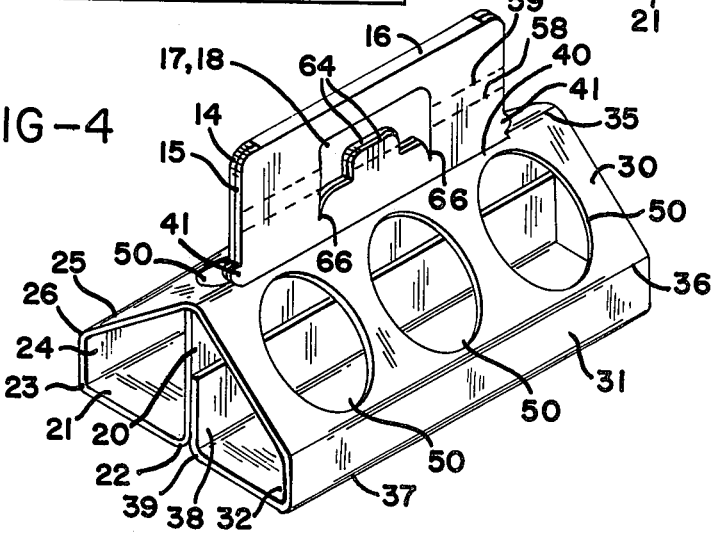
FIG. 4 is an isometric view showing the carrier folded and assembled in its erected position.

With reference to the drawings, a preferred embodiment of this invention includes a unitary or one-piece blank 10, shown in FIG. 1, which may be folded into a completed carrier 11, shown in FIG. 4. The components of the carrier blank 10 (FIG. 1) include a handle reinforcement portion 14 attached to a handle portion 15 along a fold line 16. Portions 14 and 15 include respective complementary handle cutouts 17 and 18 to provide a hand opening for manually grasping the assembled carrier.

Handle portion 15 is attached, opposite fold line 16, to a major divider wall 20 which, in turn, is attached to a first bottom wall 21 along a fold line 22 on the side of wall 20 opposite handle portion 15. A fold line 23, on the side of the first bottom wall 21 opposite fold line 22, connects wall 21 to a first lower side wall 24. First lower side wall 24, in turn, is connected on the side opposite first bottom wall 21 to a first upper side wall 25 along a fold line 26.

In the same manner, a second upper side wall 30, second lower side wall 31, and second bottom wall 32 extend serially from the first upper side wall 25, and are connected by respective fold lines 35–37. Finally, an additional, short divider wall 38 is connected to the second bottom wall 32 by a fold line 39 on the side of wall 32 opposite fold line 37.

Figure 6:
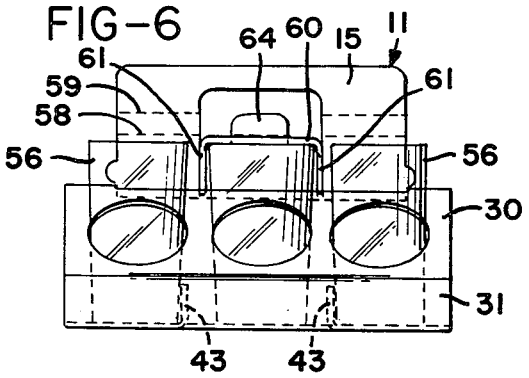
FIG. 6 is a side view showing the carrier holding relatively short glasses, and with the separator piece inserted in position.
Figure 10:
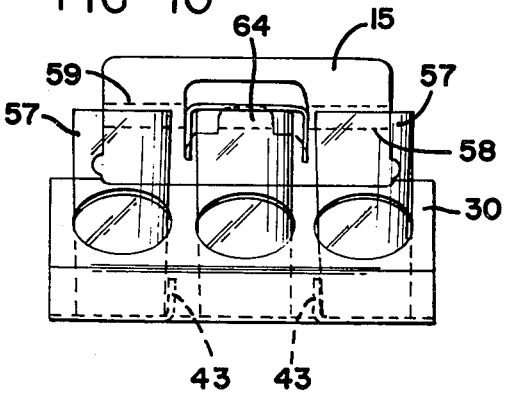
FIG. 10 is a side view similar to FIG. 6 showing the carrier holding relatively tall glasses, and with the separator piece inserted in position.

Fold line 35 includes a slot 40 of approximately the same width as handle portion 15 and handle reinforcement portion 14. Portions 14 and 15 are also provided with lock tab 41 extending from opposite sides thereof to a width greater than that of slot 40. The lock tabs 41 on handle portion 15 are located just above the major divider wall 20, on the ends of handle portion 15 opposite fold line 16. The lock tabs 41 on the handle reinforcement portion are similarly located on the end thereof opposite fold line 16 and are complementary to the lock tabs on handle portion 15. As shown in FIGS. 4, 6, and 10, when the blank 10 is folded and assembled into the carrier 11, the lock tabs 41 may be pressed through slot 40 to engage the opposite ends thereof for holding the slot in position between the tabs 41 and the top of the major divider wall 20.

Blank 10 also includes pairs of separator tabs 43 formed in the first and second bottom walls 21 and 32 by score lines 44 and fold lines 46. The fold lines 46 divide the bottom walls 21 and 32, respectively, into thirds, and allow the separator tabs 43 to be folded into the assembled carrier 11 (FIGS. 6, 7, 10, and 11) to separate articles placed therein. Similarly, each of the upper side walls 25 and 30 is provided with three elliptical cutouts 50 for receiving and accommodating six articles therethrough, and supporting and separating the articles within the carrier 11.

Figure 2:
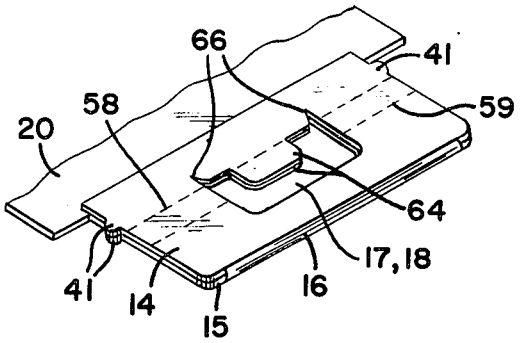
FIG. 2 is a fragmentary isometric view showing the two handle portions folded adjacent and adhered to one another.
Figure 3:
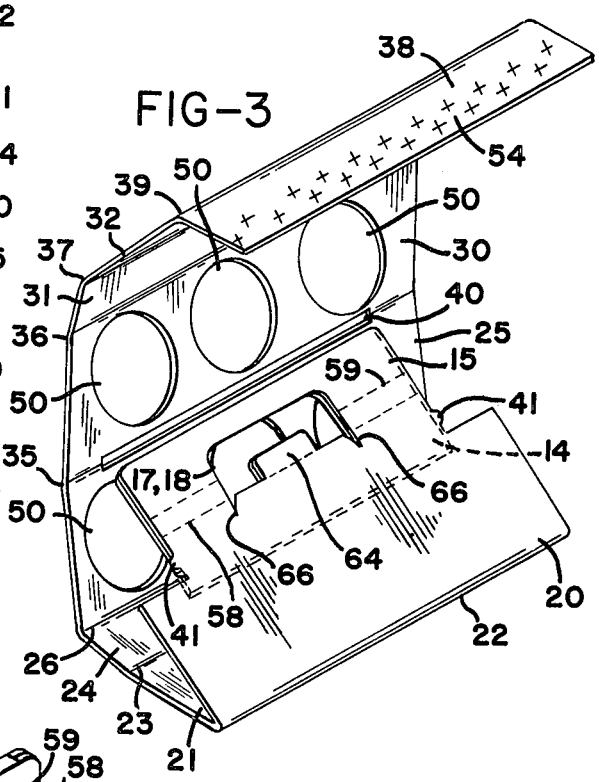
FIG. 3 is an isometric view showing the carrier in a partially folded condition.

The carrier 11 is assembled by applying a straight glue line 53 to the handle portion 15 on one side of the blank 10, and a second glue line 54 to the short divider wall 39 on the opposite side of blank 10 (see FIG. 3). Handle reinforcement portion 14 is then folded on line 16 onto glue line 53 and adhered to handle portion 15 (FIG. 2). The handle portions 14 and 15 and the major divider wall 20 then fold around fold line 22, and fold lines 23 and 26 are similarly folded, as shown in FIG. 3, to bring the handle portions 14 and 15 to and through slot 40. Short divider wall 38 is then similarly folded inwardly on fold line 39, and with the aid of fold lines 36 and 37, is brought opposite the lower end of the major divider wall 20. The divider walls 20 and 38 are then adhered to one another along glue line 54, leaving the carrier in the configuration shown in FIG. 4.

Figure 7:
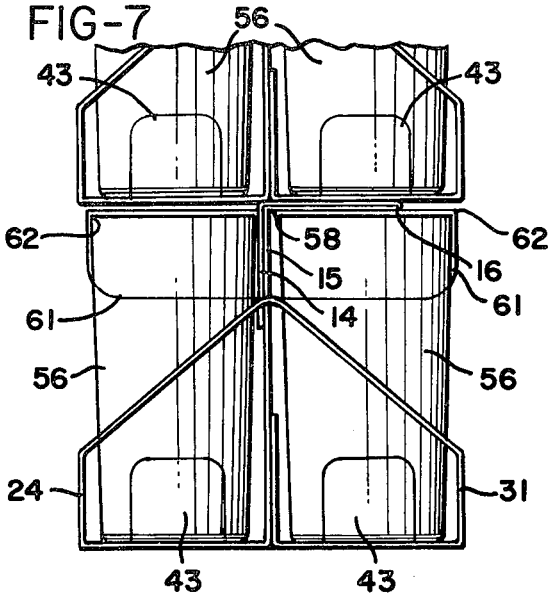
FIG. 7 is an end view of the FIG. 6 configuration showing the handle folded over and another carrier stacked on top.
Figure 11:
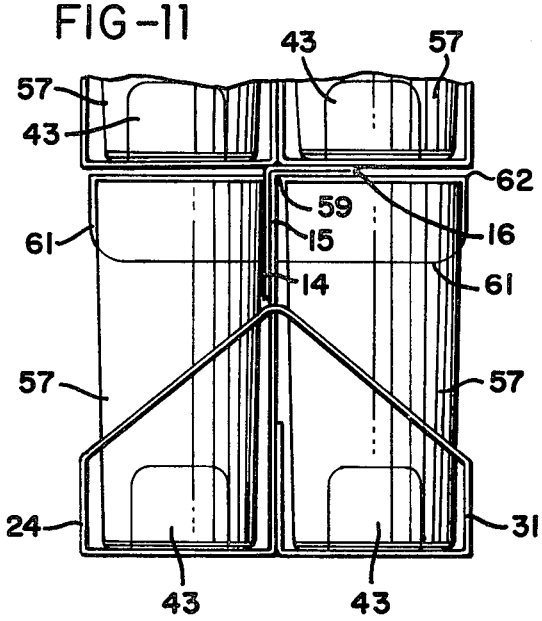
FIG. 11 is an end view of the FIG. 10 configuration showing the handled folded over and another carrier stacked on top.

In this configuration, the carrier can receive and hold relatively short or tall articles, such as the short glasses 56 illustrated in FIGS. 6 and 7, or the tall glasses 57 illustrated in FIGS. 10 and 11. When short articles, such as the short glasses 56 are carried, the carriers 11 may easily and conveniently be stacked on one another, as illustrated in FIG. 7, by folding the handle portions 14 and 15 over to one side on a lower fold line 58. As shown in FIG. 6, the lower fold line 58 is located at approximately the same height as the tops of the short glasses 56. Similarly, when relatively tall articles such as the tall glasses 57 are carried, the carriers 11 may readily be stacked upon one another, as illustrated in FIG. 11, by folding the handle portions 14 and 15 over on an upper fold line 59, located near the tops of the tall glasses 57. Thus, the single design carriers of this invention can accommodate articles of different heights and can easily be stacked upon one another regardless of the heights of the articles therein. Note that both the FIG. 6 and 7 and the FIG. 10 and 11 configuration provide excellent exposure of the contents for maximum display thereof in retail establishments.

As may be seen in the drawings, the assembled carrier configuration is one in which the major divider wall 20 is substantially vertical, the handle portion 15 extends upwardly therefrom and the handle reinforcement portion 14 extends downwardly from the handle portion 15 adjacent thereto. The first bottom wall 21 extends generally laterally away from the major divider wall 20, and the first lower side wall 24 extends generally upwardly therefrom. The first upper side wall 25 extends generally upwardly and laterally from the first lower side wall 24 to the handle portion 14 and 15. Similarly, the second upper side wall 30 extends generally downwardly and laterally from the first upper side wall 25 and the handle portions 14 and 15, the handle portions passing through the slot 40. The second lower side wall 31 extends generally downwardly from the second upper side wall 30, and the second bottom wall 32 extends generally laterally away from the second lower side wall to the major divider wall 20 and the first bottom wall 21. Finally, the short divider wall 38 extends upwardly from the second bottom wall 32 adjacent the major divider wall 20.

Figure 8:
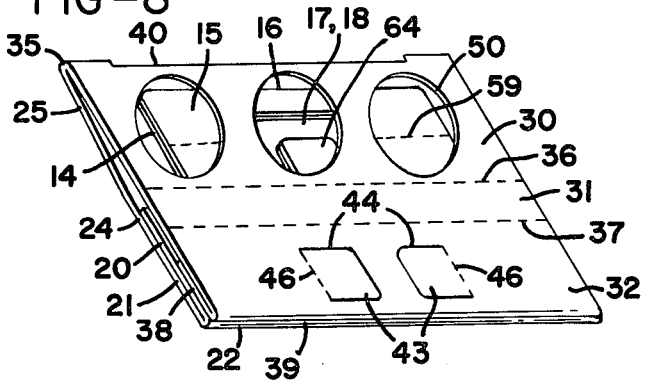
FIG. 8 is an isometric view showing the assembled carrier folded flat for shipment.

FIG. 8 illustrates the carrier 11 folded flat for shipment, the handle portions 14 and 15 simply being moved into the interior of the carrier through slot 40.

Figure 5:
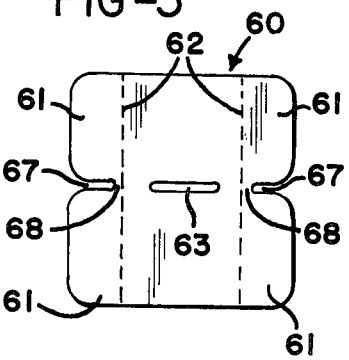
FIG. 5 is a plan view of the optional separator piece.
Figure 9:
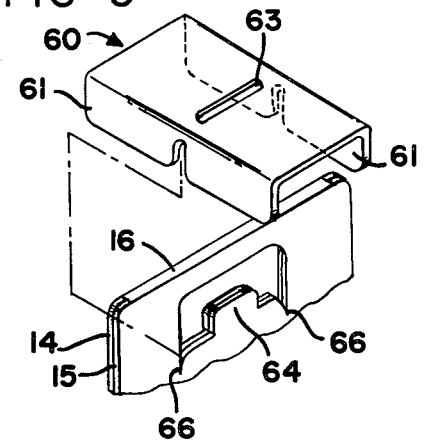
FIG. 9 is a separated, isometric view of the separator piece and a fragment of the handle, illustrating the method of assembly thereof.

FIG. 5 illustrates an optional, separate separator piece 60 which may be used in carrier 11 is separate the upper rims of the glasses 56 and 57 in order to keep them from bumping, chipping, and/or breaking one another. As shown in FIGS. 5 and 9, separator piece 60 includes wings 61 attached along fold lines 62 extending generally perpendicularly to a slot 63 formed transversely in the separator piece 60.

In use, separator piece 60 is inserted through handle cutouts 17 and 18, and slot 63 receives rim tabs 64 located on handle portions 14 and 15. The rim tabs 64 extend into the cutouts 17 and 18 from the edges thereof for separating the rims of adjacent glasses which are carried opposite one another on opposite sides of the handle cutouts 17 and 18. The rim tabs 64 are also provided with the same lower fold line 58 as on the handle portions 14 and 15, for folding over when the carriers are stacked, as in FIG. 7.

FIG. 9 illustrates the manner in which the separator piece 60 is inserted into carrier 11. First the wings 61 are folded down, then the separator piece 60 is moved laterally into and through the handle cutouts 17 and 18. As is clear from the drawings, the handle cutouts 17 and 18 are shaped to allow the separator piece 60 to move easily therethrough. For example, the handle cutouts 17 and 18 in the preferred embodiment include notches 66 which complement and accommodate the separator piece wings 61 as the separator piece is being inserted.

When the slot 63 in the separator piece is positioned directly above the rim tabs 64, the separator piece is lowered into position onto and between the articles, such as the glasses 56 or 57, in the carrier. As may be seen by comparing FIGS. 6 and 10, the separator piece 60 and slot 63 move substantially down around the rim tabs 64 when the articles are relatively short (FIG. 6), but may actually remain at the tops of, or even above, the rim tabs 64 when taller articles are in the carrier (FIG. 10). When in position, as illustrated, the wings 61 are then between and separate the top rims of the articles in the carrier.

In the preferred embodiment the separator piece 60 also includes notches 67 in the wings 61 and in line with the slot 63. The wing notches 67 permit the separator piece 60 to slide down over the handle portions 14 and 15 when shorter articles are in the carrier, as illustrated in FIGS. 6 and 9. However, the wing notches 67 do not extend entirely to their respective fold lines 62. This leaves a small web 68 of material which engages the sides of the handle cutouts 17 and 18 to hold the wings in their downwardly folded position (FIGS. 6, 9, and 10).

As may be seen, therefore, the present invention provides numerous advantages. It may be assembled easily and inexpensively, and can handle relatively short or tall glasses or bottles with a single design configuration. It will keep them in separated, upright positions to avoid breakage in transit, may easily be stacked regardless of their heights, and will provide maximum shelf exposure for these articles in retail establishments. It may be formed with but a single die and two glue lines, using straight line carton gluing equipment. It uses a minimum of paperboard material, may be folded flat for shipment, and can be easily erected and assembled by the user. Individualization of the cartons can be effected by appropriately printed separator pieces, which can serve as merchandiser cards, so that the carriers themselves can be further standardized for best economy.

While the form of apparatus herein described constitutes a preferred embodiment of this invention, it is to be understood that the invention is not limited to this precise form of apparatus, and that changes may be made therein without departing from the scope of the invention.

What is claimed is:

1. A carrier for glasses or bottles comprising a generally vertical major divider wall, a handle portion extending upwardly from said major divider wall, means forming a cutout in said handle portion to provide a hand opening for manually grasping the carrier, a first bottom wall extending generally laterally away from said major divider wall, a first lower side wall extending generally upwardly from said first bottom wall, a first upper side wall extending generally upwardly and laterally from said first lower side wall to said handle portion, a second upper side wall extending generally downwardly and laterally from said first upper side wall and said handle portion, means forming a slot in said carrier between said first and second upper side walls for said handle portion and said handle portion passing upwardly through said slot, means forming openings through said first and second upper side walls for receiving the glasses or bottles therethrough, a second lower side wall extending generally downwardly from said second upper side wall, a second bottom wall extending generally laterally away from said second lower side wall to said major divider wall and said first bottom wall, an additional divider wall extending upwardly from said second bottom wall adjacent said major divider wall, means adhering said additional divider wall to said major divider wall, a separate separator piece passing through said handle cutout above said upper side walls, and wings on said separator piece extending downwardly above said upper side walls substantially between said openings therein for separating the tops of glasses or bottles within said openings in said carrier.

2. The carrier of claim 1 further comprising a rim tab extending into said handle cutout from the edge thereof for separating the tops of glasses or bottles carried thereadjacent, and means forming a rim tab receiving slot in said separator piece for receiving said rim tab therein for accommodating said rim tab and vertically positioning said separator piece in said handle portion and in said carrier according to the heights of the glasses or bottles within said carrier.

3. The carrier of claim 1 further comprising means forming notches in said wings aligned with said handle portion for receiving said handle portion in said notches to provide for sliding said wings downwardly over said handle portion.

4. The carrier of claim 3 wherein said separator piece extends substantially from one side of said handle cutout to the other, wherein said notches extend away from said separator piece, and further comprising means forming webs in said notches adjacent said separator piece for engaging the sides of said handle cutout to hold said wings in a downwardly folded position.

5. A two position carrier for glasses or bottles comprising a generally vertical major divided wall, a handle portion extending upwardly from said major divider wall, a handle reinforcement portion extending downwardly from and adjacent said handle portion, means adhering said handle reinforcement portion to said handle portion, a first bottom wall extending generally laterally away from said major divider wall, a first lower side wall extending generally upwardly from said first bottom wall, a first upper side wall extending generally upwardly and laterally from said first lower side wall to said handle portions, a second upper side wall extending generally downwardly and laterally from said first upper side wall and said handle portions, means forming a slot in said carrier between said first and second upper side walls for said handle portions and said handle portions passing upwardly through said slot, means forming elliptical openings through said first and second upper side walls for receiving the glasses or bottles therethrough, a second lower side wall extending generally downwardly from said second upper side wall, a second bottom wall extending generally laterally away from said second lower side wall to said major divider wall and said first bottom wall, an additional divider wall extending upwardly from said second bottom wall adjacent said major divider wall, means adhering said additional divider wall to said major divider wall, lock tabs extending from opposite sides of said handle portions above said major divider wall for engaging the ends of said slot and holding it in position between said tabs and the top of said major divider wall, means forming separator tabs in said bottom walls, said separator tabs extending into said carrier for separating the glasses or bottles from one another, means forming complementary cutouts in said handle portions to provide a hand opening for manually grasping the carrier, a separate separator piece passing through said handle cutouts above said upper side walls, rim tab means extending into said handle cutouts from the edges thereof for separating the tops of glasses or bottles carried thereadjacent, means forming a rim tab receiving slot in said separator piece for receiving said rim tab means therein for accommodating said rim tab and vertically positioning said separator piece in said handle portions and in said carrier according to the heights of the glasses or bottles within said carrier, and wings on said separator piece extending downwardly for separating the tops of glasses or bottles within said carrier.

6. Two blanks for forming a carrier for glasses or bottles, the first blank comprisng a handle portion, means forming a cutout in said handle portion to provide a hand opening therein, a major divider wall extending from said handle portion, a first bottom wall foldably extending from said major divider wall opposite said handle portion, a first lower side wall foldably extending from said first bottom wall opposite said major divider wall, a first upper side wall foldably extending from said lower side wall opposite said first bottom wall, a second upper side wall foldably extending from said first upper side wall opposite said first lower side wall, means forming a slot in said blank between said first and second upper side walls, said slot having a width corresponding to that of said handle portion, means forming openings through said first and second upper side walls for receiving the glasses or bottles, a second lower side wall foldably extending from said second upper side wall opposite said first upper side wall, a second bottom wall foldably extending from said second lower side wall opposite said second upper side wall, and an additional divider wall foldably extending from said second bottom wall opposite said second lower side wall, the second blank comprising a separate separator piece having wings foldably extending from opposite sides thereof and sized for positioning within said handle cutout with said wings spaced at distances aligned substantially with the portions of said upper side walls between said openings therein.

7. The carrier blanks of claim 6 further comprising means forming notches in said wings for receiving said handle portion in said notches to provide for sliding said wings over said handle portion when said separator piece is positioned within said handle cutout.

8. The carrier blanks of claim 7 wherein said separator piece is sized to extend substantially from one side of said handle cutout to the other when positioned therein, wherein said notches extend away from said separator piece, and further comprising means forming webs in said notches adjacent said separator piece for engaging the sides of said handle cutout when positioned therein to hold said wings in a folded position.

9. Two blanks for forming a two position carrier for glasses or bottles, the first blank comprising a handle portion, a handle reinforcement portion foldably extending from said handle portion, a major divider wall extending from said handle portion opposite said handle reinforcement portion, a first bottom wall foldably extending from said major divider wall opposite said handle portion, a first lower side wall foldably extending from said first bottom wall opposite said major divider wall, a first upper side wall foldably extending from said lower side wall opposite said first bottom wall, a second upper side wall foldably extending from said first upper side wall opposite said first lower side wall, means forming a slot in said blank between said first and second upper side walls, said slot having a width corresponding to that of said handle portion, means forming ellipitical openings through said first and second upper side walls for receiving the glasses or bottles, a second lower side wall foldably extending from said second upper side wall opposite said first upper side wall, a second bottom wall foldably extending from said second lower side wall opposite said second upper side wall, an additional divider wall foldably extending from said second bottom wall opposite said lower side wall, lock tabs extending from opposite sides of said handle portion adjacent said major divider wall and complementary lock tabs extending from opposite sides of said handle reinforcement portion, the distance between the ends of said tabs being greater than the length of said slot, means forming separator tabs in said bottom walls, means forming complementary cutouts in said handle portion and said handle reinforcement portion to provide a hand opening therein, and a rim tab extending into said handle cutout from the edge thereof, the second blank comprising a separate piece having wings foldably extending from opposite sides thereof, and means forming a complementary rim tab receiving slot transversely in said separator piece.

* * * * *